United States Patent [19]

Gray

[11] 4,090,511

[45] May 23, 1978

[54] MOUTHPIECE VALVE FOR ESCAPE BREATHING APPARATUS

[75] Inventor: Robert Elder Gray, Pittsburgh, Pa.

[73] Assignee: Mine Safety Appliances Company, Pittsburgh, Pa.

[21] Appl. No.: 780,409

[22] Filed: Mar. 23, 1977

[51] Int. Cl.[2] ..... A62B 7/00

[52] U.S. Cl. ..... 128/147; 128/142 R

[58] Field of Search ..... 128/147, 142 R, 142.2, 128/142.3, 142.5, 191 R, 208, 145 A

[56] References Cited

U.S. PATENT DOCUMENTS

| | | | |
|---|---|---|---|
| 2,874,692 | 2/1959 | Galeazzi | 128/142 R |
| 2,882,895 | 4/1959 | Galeazzi | 128/142 R |
| 3,266,490 | 8/1966 | Klinger et al. | 128/147 |

FOREIGN PATENT DOCUMENTS

| | | | |
|---|---|---|---|
| 301,632 | 9/1919 | Germany | 128/147 |
| 2,600,227 | 7/1976 | Germany | 128/142.2 |

*Primary Examiner*—Kyle L. Howell
*Assistant Examiner*—Henry J. Recla
*Attorney, Agent, or Firm*—Brown, Murray, Flick & Peckham

[57] ABSTRACT

A valve housing has a mouth port in one side and a vent opening in its opposite side, with another opening between them for connection to a carbon dioxide removing and oxygen generating canister. Around the mouth port inside the housing is a valve seat, toward which a valve member is urged by a spring to normally close the valve. Surrounding the valve member and spring is a bellows that has an open end secured to the housing around the vent opening to thereby expose the inside of the bellows to the pressure of water or other liquid in which the valve may be submerged. Connected to the outer end of the mouthport is a mouthpiece adapted to be held in the mouth of a user, and encircling the mouthpiece is a ring that is connected with the valve member for movement with it. The ring normally is so positioned on the mouthpiece that it must be moved toward the housing to permit the mouthpiece to be held in the mouth with the lips against the ring to thereby hold the valve open, but if the mouthpiece is removed from the mouth the spring and fluid pressure inside the bellows will close the valve.

6 Claims, 4 Drawing Figures

MOUTHPIECE VALVE FOR ESCAPE BREATHING APPARATUS

The government has rights in this invention pursuant to Contract No. NOO24-74-C-5500 awarded by the Department of The Navy.

Escape breathing apparatus is known, in which a mouthpiece is connected with a canister containing a rebreather chemical, such as potassium superoxide. The chemical removes carbon dioxide from the exhaled breath, and the moisture in the breath causes the chemical to produce oxygen that is then inhaled. When such apparatus is designed for use in a ship disaster where it would be used to traverse areas containing sea water, possibly contaminated with oil, gasoline, or some other liquid, it would be desirable to provide the apparatus with a valve that will close automatically in case the valve is released from the mouth and submerged, so that liquid will be prevented from entering the canister where it would deplete the chemical. Also, if the liquid is something other than plain water, it might have an adverse reaction with the chemical in the canister.

It is among the objects of this invention to provide emergency breathing apparatus in areas where contaminated water may be present, in which a mouthpiece valve will automatically close and prevent the water from entering the canister in case the mouthpiece is accidentally released from the user's mouth and submerged, which has means for opening the valve just before insertion of the mouthpiece in the mouth, which is provided with means for holding the valve open during use without causing discomfort to the user, and in which the valve is closed more tightly as it is submerged to a greater depth.

The preferred embodiment of the invention is illustrated in the accompanying drawings, in which FIG. 1 is a view of the front of the valve;

Figure 1:
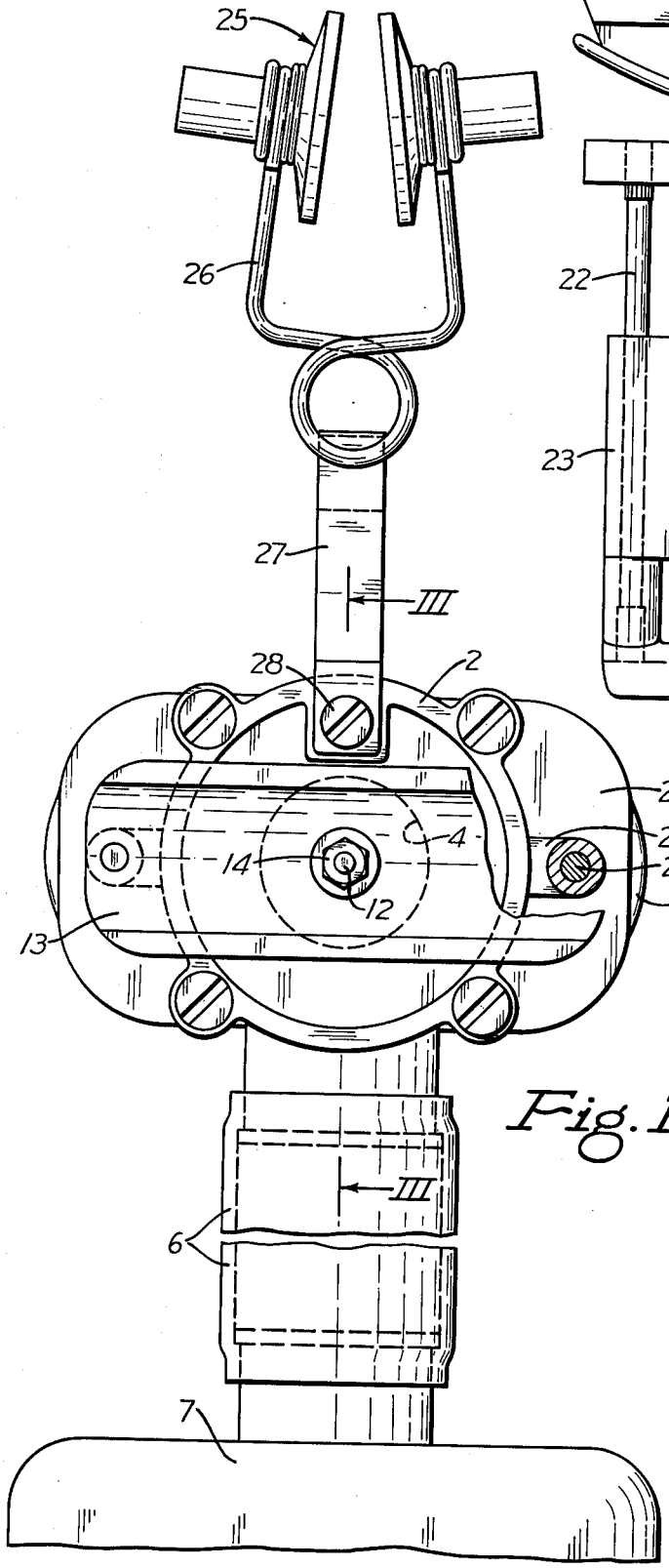
Figure 2:
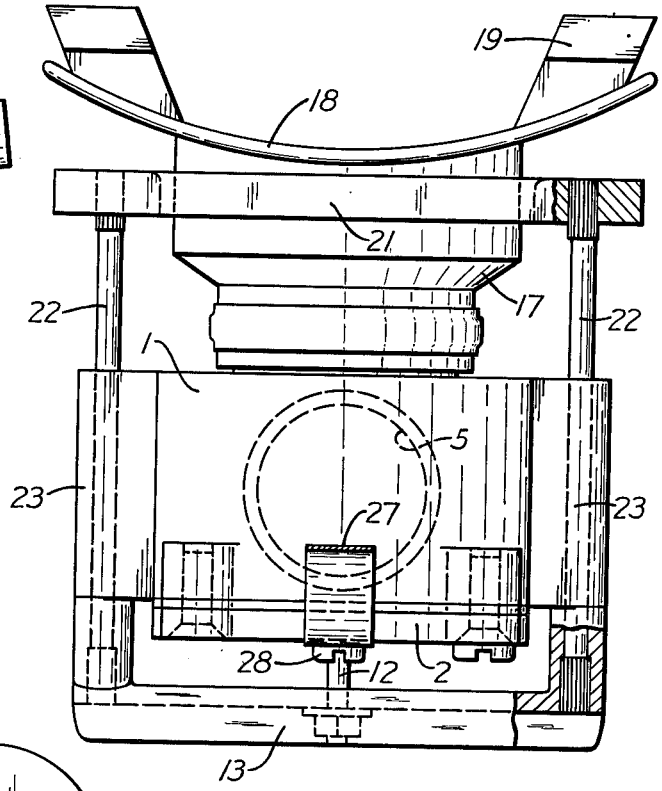
FIG. 2 is a plan view, partly in section.

Referring to the drawings, a valve housing 1, including a front cover 2, is provided in the side opposite the cover with a port 3 shown in FIGS. 3 and 4, to which is connected a mouthpiece to be described later. The side of the housing opposite to mouth port 3 has a large vent opening 4 (FIG. 3) therethrough. Between this opening and the mouth port the housing is provided with a third opening 5 that is connected, as shown in FIG. 1, by a hose 6 with a rebreather canister 7 containing a suitable chemical for removing carbon dioxide from the air exhaled through it and generating oxygen for inhalation through the valve.

Figure 4:
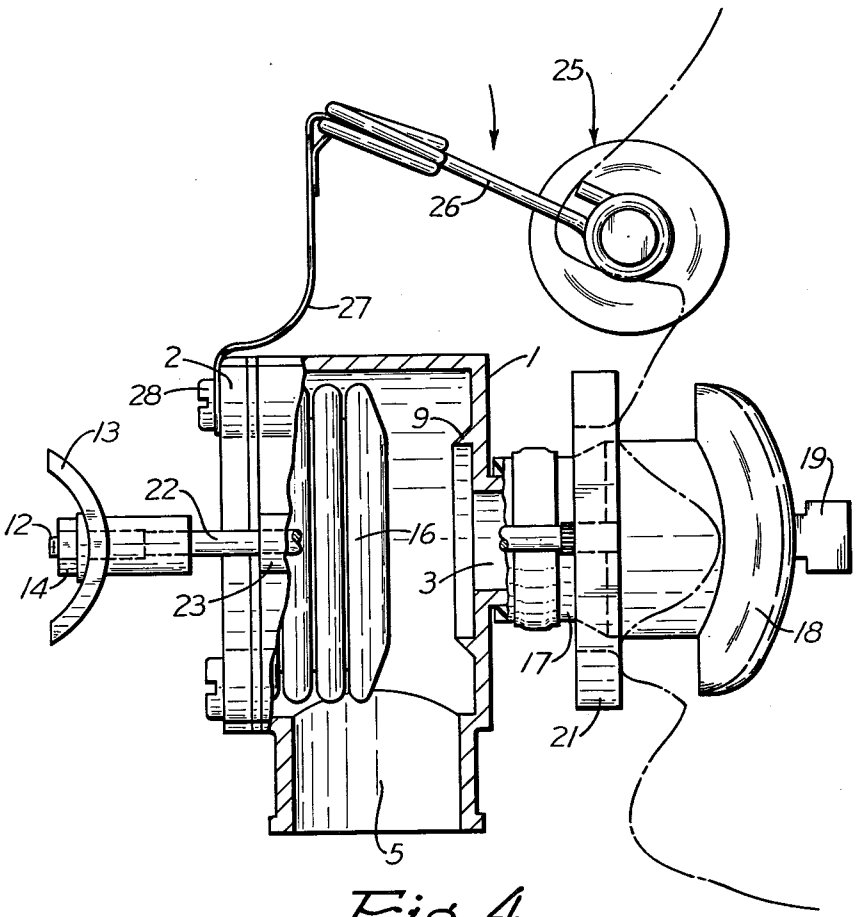
FIG. 4 is a view similar to FIG. 3 of the valve in operating position.
Figure 3:
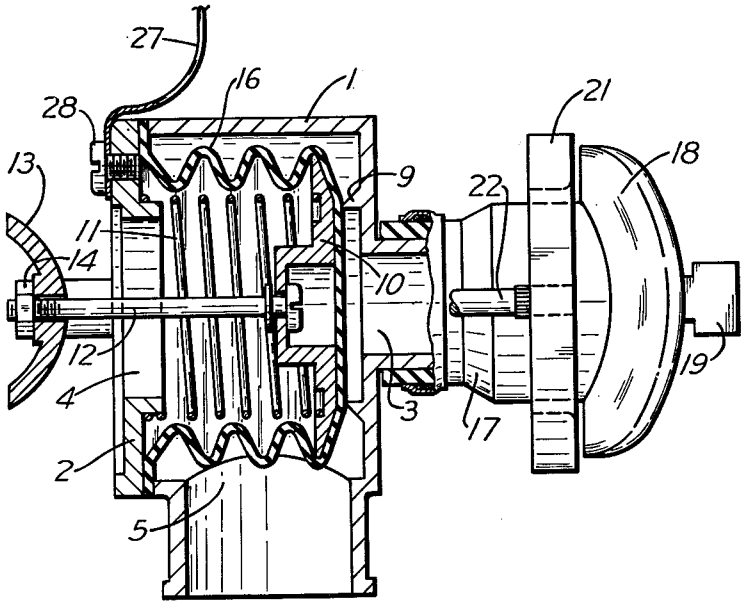
FIG. 3 is a vertical section taken on the line III—III of FIG. 1.

As shown in FIGS. 3 and 4, inside the valve housing there is a valve seat 9 encircling the mouth port. Opposed to this seat is a valve member 10 that is urged toward the seat by a coil spring 11 compressed between the valve member and the housing cover 2. The valve member may be a flat ring encircling an integral cup, in which the head of a long threaded stud 12 is disposed. The stud extends forward through the valve member and coil spring and out of the housing through the vent opening. In front of the housing the outer end of the stud extends through a cross bar 13, which is held on the stud by means of a nut 14 on the stud. The stud has a small amount of loose play lengthwise in the valve member and cross bar.

The valve member and the spring are surrounded by a bellows 16 that has an open end sealed against the housing around the vent opening, such as being clamped in place by the cover. The other end of the bellows is either secured to the valve member or, preferably, is closed and bears against the side of the valve member facing the valve seat. The closed end forms a good seal between the valve member and its seat.

The mouthpiece includes a tube 17 attached to the valve housing around the mouth port. The outer or rear end of this tube is surrounded by an integral flange 18 adapted to be held in the mouth between the lips and gums. The end portions of the flange are provided with integral bite pieces 19 to be gripped by the teeth to hold the mouthpiece in place, with the lips surrounding and engaging the outside of the tube in front of its flange.

Slidably mounted on the mouthpiece tube is a lip ring 21 or plate through which the tube extends. This plate is secured to the rear ends of a pair of pins 22, which are slidably mounted in ears 23 projecting from the opposite ends of the housing. The projecting front ends of the pins are rigidly mounted in the ends of the cross bar 13. Consequently, when the valve is closed as shown in FIG. 3, the cross bar and pins hold the lip ring in its rear position close to flange 18, but if the cross bar is pulled forward away from the housing to open the valve, the ring will be pulled forward on the tube as shown in FIG. 4.

OPERATION

To make this valve ready for insertion in the mouth, the user grasps the valve and places two fingers between the cross bar 13 and the valve housing. With those fingers he then moves the bar forward, which compresses the bellows, pulls the valve open and pulls the lip ring toward the housing. This creates a space between the ring and flange 18 that allows the flange to be inserted in the mouth with the user's lips surrounding the mouthpiece behind the ring as shown in FIG. 4. Then the cross bar can be released because the lips will maintain the ring in its forward position, and that will hold the valve open. The spring force is light to prevent discomfort to the user when the spring presses the ring against the lips.

When the valve is removed from the mouth, either accidentally or intentionally, the areas on both sides of the bellows are open to the pressure of the surrounding fluid, be it gas or liquid. The exposed side of valve member 10 inside the bellows has a greater area than the area surrounded by the valve seat, so the effective pressure area inside the bellows against the valve member is greater than the pressure in the opposite direction, which is particularly effective if the mouthpiece is inadvertently submerged in a liquid. The deeper the valve is submerged, the greater the closing force on the valve member.

Above the valve there is a nose clip 25 mounted on the upper end of a torsion spring 26 as shown in FIG. 1. The lower end of the spring is secured to the upper end of a leaf spring 27, the lower end of which curves forward and is attached to the front of the valve housing by a screw 28. The nose clip is thus in a position where it will not interfere with mouthpiece insertion, yet it is in the line of vision of the user when he inserts the mouthpiece in his mouth and is easily accessible for placement on the nose as shown in FIG. 4. When stored in the carrying case for the valve, leaf spring 27 is sprung down onto housing 1 with the nose clip spring 26 above the mouthpiece, but when the valve is removed from the case, the nose clip will spring up to its upper position shown in FIG. 1.

The mouthpiece valve disclosed herein is intended especially for use by Navy personnel aboard a ship who would have no training in underwater diving but who might be exposed to a ship disaster involving a fire or other cause of toxic gas, which would require respiratory protection during escape from some interior portion of the ship to the ship's weather deck. It is quite conceivable that as they traverse some areas of the ship in order to reach the weather deck, they may encounter areas which are flooded, requiring that they wade, possibly waist deep, in sea water that may well be contaminated with oil, gasoline, or other substance that may react with the rebreather chemical. It is also conceivable that a man might have to submerge his head in water for a short period during his escape; however, this would only last for several seconds before he would again have his head above water. Another possible exposure of the breathing apparatus to contaminated water would be the rare case of Navy personnel being required to abandon ship after reaching the weather deck and if they were to do so without removing the apparatus, but this possibility is rather low, since the personnel are supposed to remove the apparatus upon reaching the weather deck.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A mouthpiece valve for escape breathing apparatus, comprising a tubular valve housing provided in one side with a mouth port and in its opposite side with a vent opening, the housing also having between said port and vent opening an opening for connection to a carbon dioxide removing and oxygen generating canister, a valve seat inside the housing around said port, a valve member in the housing, a spring urging the valve member toward said seat to normally close the valve, a bellows surrounding said valve member and spring and having an open end secured to said housing around said vent opening to thereby continually expose the inside of the bellows to the pressure of liquid in which the valve may be submerged, a mouthpiece connected to the outer end of said port and adapted to be held in the mouth of a user, a ring slidably mounted on said valve housing adjacent the mouthpiece, and means connecting said valve member with the ring for movement therewith, such that the ring is positioned adjacent the mouthpiece and must be moved toward the housing in order to permit the mouthpiece to be held in the mouth with the lips behind the ring, thereby opening the valve, and the valve being adapted to be closed by said spring and liquid pressure inside the bellows when the mouthpiece is removed from the mouth and submerged in a liquid.

2. A mouthpiece valve according to claim 1, in which said connecting means extend through said vent opening.

3. A mouthpiece valve according to claim 1, in which said connecting means extend through said vent opening and include manually actuated means outside of said housing for pulling said ring toward the valve housing before the mouthpiece is inserted in the mouth.

4. A mouthpiece valve according to claim 1, in which said connecting means include a stud extending through said vent opening with one end rigidly connected to said valve member, a bar extending across the opposite end of the stud and mounted thereon, and pins connected at one end to said ring and at their other end to said bar, whereby when the bar is pulled away from said housing to open the valve it will pull the ring toward the housing.

5. A mouthpiece valve according to claim 1, in which the end of said bellows adjoining said valve member is closed and covers the side of the valve member facing said valve seat.

6. A mouthpiece valve according to claim 1, including a nose clip, and a leaf spring secured at one end to said clip, the spring normally extending above the housing when the valve is first inserted in the mouth but permitting the clip to be swung down for clamping onto the nose.

* * * * *